US008322837B2

(12) United States Patent
Kitamura

(10) Patent No.: US 8,322,837 B2
(45) Date of Patent: Dec. 4, 2012

(54) LIQUID EJECTING APPARATUS

(75) Inventor: Kenichi Kitamura, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 106 days.

(21) Appl. No.: 13/045,122

(22) Filed: Mar. 10, 2011

(65) Prior Publication Data

US 2011/0242235 A1 Oct. 6, 2011

(30) Foreign Application Priority Data

Mar. 31, 2010 (JP) ..... 2010-081519

(51) Int. Cl.
*B41J 2/18* (2006.01)
*B41J 2/235* (2006.01)

(52) U.S. Cl. ..... 347/89; 347/20; 347/85

(58) Field of Classification Search ..... 347/89
See application file for complete search history.

(56) References Cited

U.S. PATENT DOCUMENTS 6,116,727 A * 9/2000 Hagiwara ..... 347/89
6,361,159 B1 * 3/2002 Chino ..... 347/86
6,402,308 B1 * 6/2002 Hattori et al. ..... 347/86
7,011,507 B2 * 3/2006 Seto et al. ..... 417/412
7,401,907 B2 * 7/2008 Perez ..... 347/84
2003/0197766 A1 * 10/2003 Barinaga et al. ..... 347/85
2004/0017446 A1 * 1/2004 Ando et al. ..... 347/85
2010/0013893 A1 * 1/2010 Akahane ..... 347/65
2010/0238340 A1 * 9/2010 Hamasaki ..... 348/311
2011/0021835 A1 * 1/2011 Clement et al. ..... 564/229

FOREIGN PATENT DOCUMENTS

JP 2009-023289 2/2009
JP 2009-184264 8/2009

* cited by examiner

*Primary Examiner* — Dameon Levi
*Assistant Examiner* — Patrick King
(74) *Attorney, Agent, or Firm* — Workman Nydegger

(57) ABSTRACT

A liquid ejecting apparatus comprising: a liquid reservoir unit, a liquid ejection head, a supply channel, a collecting channel; and a first pressure applied to the downstream side of the valve member in the circulation channel by the suction pump is larger than a second pressure on the downstream side of the valve member in the circulation channel required for causing the film to act so that the valve member opens the circulation channel, and a sum of a waterhead pressure determined by the height from the liquid reservoir unit to the circulation channel opened and closed by the valve member provided in each of the circulation channel and the first pressure is smaller than the second pressure.

2 Claims, 6 Drawing Sheets

LIQUID EJECTING APPARATUS

The entire disclosure of Japanese Patent Application No: 2010-081519, filed Mar. 31, 2010 are expressly incorporated by reference herein.

BACKGROUND

1. Technical Field

The present invention relates to a liquid ejecting apparatus having a liquid ejection head configured to eject liquid supplied from a liquid reservoir unit having liquid stored therein from nozzle openings.

2. Related Art

As a liquid ejecting apparatus configured to eject liquid on ejected media, for example, an ink jet recording apparatus configured to perform printing on an ink-ejected medium such as a paper or a recording sheet by causing ink to be ejected as liquid is known.

There has also been proposed an ink jet recording apparatus including a drum-type platen that causes an ink-ejected medium to be wound therearound and ink jet recording heads provided around the platen, and in which printing is performed on the ink-ejected medium by the ink jet recording heads (see JP-A-2009-184264, for example).

In contrast, there has been proposed an ink jet recording apparatus configured to circulate ink by returning ink supplied from a reservoir unit having ink stored therein to the reservoir unit (see JP-A-2009-23289, for example).

With an ink jet recording apparatus of this type, precipitation of an ink component can be restrained and uniformization of ink temperature is achieved by circulating the ink. Also, by circulating the ink, air bubbles in the ink jet recording head can be returned to the reservoir unit, thereby achieving an advantage of being superior in air-bubble discharging performance.

However, if an ink jet recording head having a plurality of nozzle row groups including one or more nozzle rows and a plurality of circulation channels communicating with the nozzle row groups respectively is arranged at an angle which results in the circulating channels being positioned at different levels in the vertical direction as in JP-A-2009-184264, there arises a difference in waterhead pressure due to the difference in level of the circulation channels. Consequently, the supply pressure of ink fluctuates from one nozzle row group to another, whereby fluctuations in ink discharging characteristics due to the fluctuations in supply characteristics may disadvantageously result.

If the plurality of ink jet recording heads are arranged at different positions in the vertical direction, there also arises a difference in waterhead pressure among the plurality of ink jet recording heads, so that fluctuations in ink discharging characteristics may disadvantageously occur among the ink jet recording heads.

Such problems exist not only in an ink jet recording apparatus, but also in a liquid ejecting apparatus which ejects liquid other than ink.

SUMMARY

An advantage of some aspects of the invention is that it provides a liquid ejecting apparatus which achieves improvement of printing quality by uniformizing the liquid discharging characteristics of liquid discharged from nozzle row groups.

According to a first aspect of the invention, there is provided a liquid ejecting apparatus comprising: a liquid reservoir unit having liquid stored therein; a liquid ejection head having a plurality of nozzle rows including nozzle openings aligned in a line for ejecting liquid; a supply channel configured to supply the liquid from the liquid reservoir unit to the liquid ejection head; a collecting channel through which the liquid is collected from the liquid ejection head to the liquid reservoir unit; and a suction pump provided in the collecting channel and configured to suck liquid in the liquid ejection head, wherein the liquid ejection head includes a plurality of circulation channels provided so as to communicate with the respective nozzle row groups each made up of one or more nozzle rows and communicating the supply channel and the collecting channel, the each circulation channel includes: a valve member provided on the upstream side of the connecting portion which communicates with the nozzle row group of the circulation channel and configured to open and close the circulation channel; and a film configured to seal the circulation channel, be displaced toward the circulation channel on the basis of the negative pressure and the atmospheric pressure which act on the circulation channel on the downstream side with respect to the valve member, and open the circulation channel by moving the valve member by transmitting the displacement to the valve body, a first pressure applied to the downstream side of the valve member in the circulation channel by the suction pump is larger than a second pressure on the downstream side of the valve member in the circulation channel required for causing the film to act on the valve member to open the circulation channel, and a sum of a waterhead pressure determined by the height from the liquid reservoir unit to the circulation channel opened and closed by the valve member provided in the each circulation channel and the first pressure is smaller than the second pressure.

In this configuration, even when the liquid ejection head is mounted so as to generate a difference in waterhead pressure, the difference in waterhead pressure is absorbed by the valve member and hence the liquid can be supplied always at a constant pressure to the nozzle row group. Therefore, the ejecting characteristics of the liquid can be uniformized among the plurality of nozzle row groups.

Preferably, a plurality of the liquid ejection heads are provided, and the plurality of liquid ejection heads are provided at different levels in the vertical direction. In this configuration, even when the difference in waterhead pressure is generated in the plurality of liquid ejection heads, the difference in waterhead pressure is absorbed by the valve member and hence the liquid can be supplied always at a constant pressure to the plurality of liquid ejection heads. Therefore, the ejecting characteristics of the liquid can be uniformized among the plurality of liquid ejection heads.

BRIEF DESCRIPTION OF THE DRAWINGS

The invention will be described with reference to the accompanying drawings, wherein like numbers reference like elements.

DESCRIPTION OF EXEMPLARY EMBODIMENTS

The invention will be described in detail below on the basis of embodiments.

First Embodiment

Figure 1:
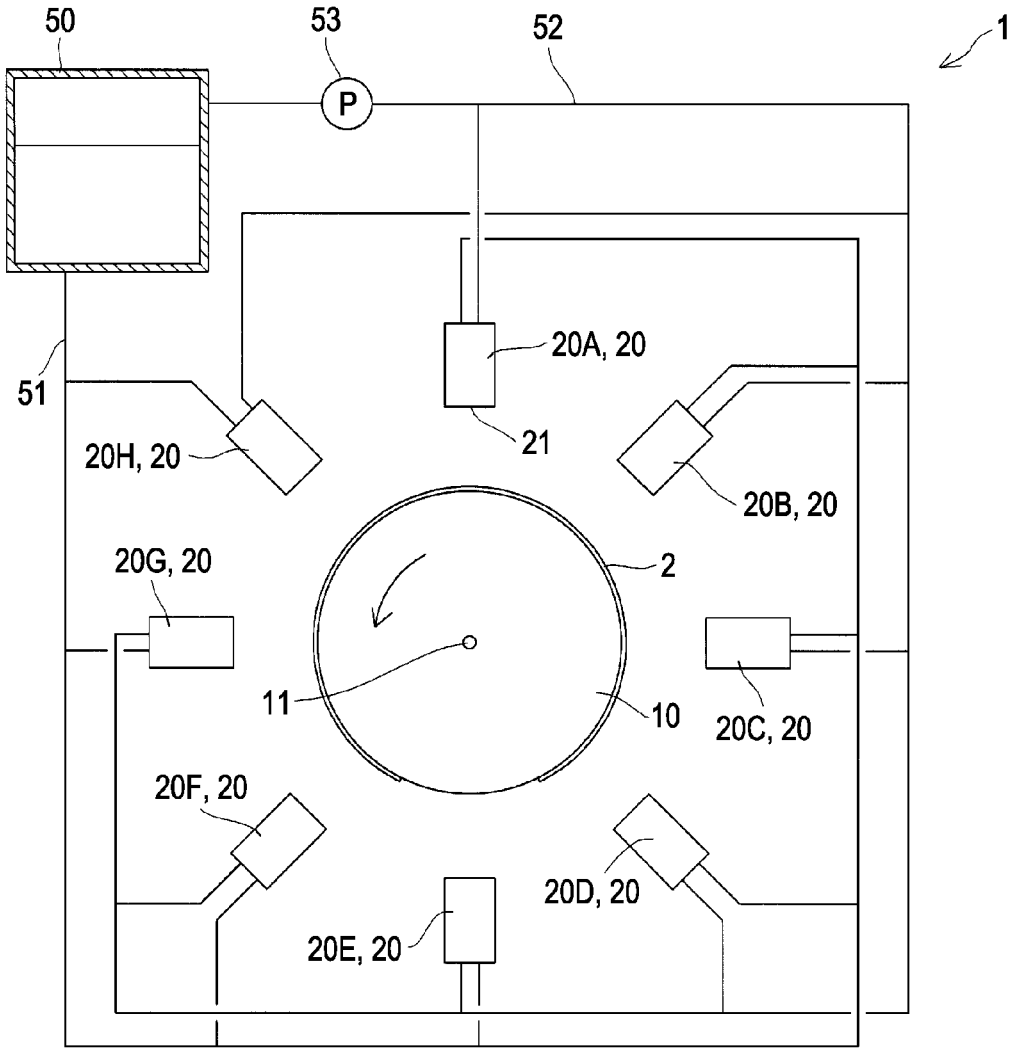
FIG. 1 is a plan view of a recording apparatus according to a first embodiment.

FIG. 1 is a plan view of an ink jet recording apparatus as an example of a liquid ejecting apparatus according to a first embodiment of the invention.

As shown in FIG. 1, an ink jet recording apparatus 1 as an example of the liquid ejecting apparatus in the first embodiment includes a column-shaped supporting member 10, a plurality of ink jet recording heads 20A to 20H (hereinafter, referred to simply as recording heads 20) arranged so that discharging surfaces 21 configured to discharge ink oppose the supporting member 10, and a liquid reservoir unit 50 having ink to be supplied commonly to the recording heads 20A to 20H stored therein.

The supporting member 10 holds an ink-ejected medium 2 such as a paper or a recording sheet transported by a transporting unit, which is not shown, on the side opposite from a printing surface to be subjected to printing, and supports the opposite side from the printing surface when the liquid recording heads 20 perform printing on the printing surface. A method of holding the ink-ejected medium 2 used by the supporting member 10 is not specifically limited and, for example, a method of causing the surface of the ink-ejected medium 2 opposite from the printing surface to be sucked and attached to the surface of the supporting member 10 is exemplified. As another holding method, for example, a method of electrically charging an outer peripheral surface of the ink-ejected medium 2 and causing the ink-ejected medium 2 to be attached onto the supporting member 10 by the action of dielectric polarization is exemplified. It is also possible to provide a holding roller or the like for supporting the ink-ejected medium 2 with the surface of the supporting member 10 therebetween as a matter of course.

The supporting member 10 is supported by a revolving shaft 11 so as to rotate in the circumferential direction. The supporting member 10 is rotated by a drive unit such as a drive motor, not shown.

A plurality of recording heads 20 are arranged so that the directions of the discharging surfaces 21 oppose an ejected surface of the ink-ejected medium 2 supported by the supporting member 10 and form different installation angles. In the first embodiment, taking the vertical direction as a reference direction, the recording heads 20 are provided on both sides of the supporting member 10 with respect to the reference direction, and the recording heads 20 are provided on both sides in the horizontal direction orthogonal to the reference direction. The recording heads 20 are provided at positions inclined with respect to the reference direction by approximately 45 degrees, respectively. In other words, in the first embodiment, the eight recording heads 20 are arranged as the ink jet recording heads 20A to 20H substantially equidistantly at angles of approximately 45 degrees along the circumferential direction of the supporting member 10. The discharging surfaces 21 of the respective recording heads 20A to 20H are arranged so as to face the revolving shaft 11 of the supporting member. Accordingly, the recording heads 20A to 20H are arranged at different positions in the vertical direction. In the first embodiment, the recording heads 20A to 20H are arranged clockwise in sequence from the recording head 20A positioned on the upper side in the vertical direction at intervals of 45 degrees about the revolving shaft 11.

Although not shown specifically in the drawing, the respective ink jet recording heads 20 are provided so as to be movable in the direction of the axis of the revolving shaft 11 of the supporting member 10. The method of moving the ink jet recording heads 20 as described above is exemplified, for example, by a method of providing rails along the direction of the axis of the revolving shaft 11 of the supporting member 10, holding the ink jet recording heads 20 on the rails so as to be movable therealong, and moving the ink jet recording heads 20 along the rails by a drive motor, a transporting belt, and so on.

Figure 2A:
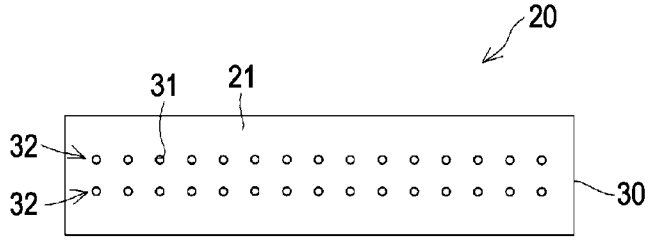
FIG. 2A is a plan view of a recording head according to the first embodiment.
Figure 2B:
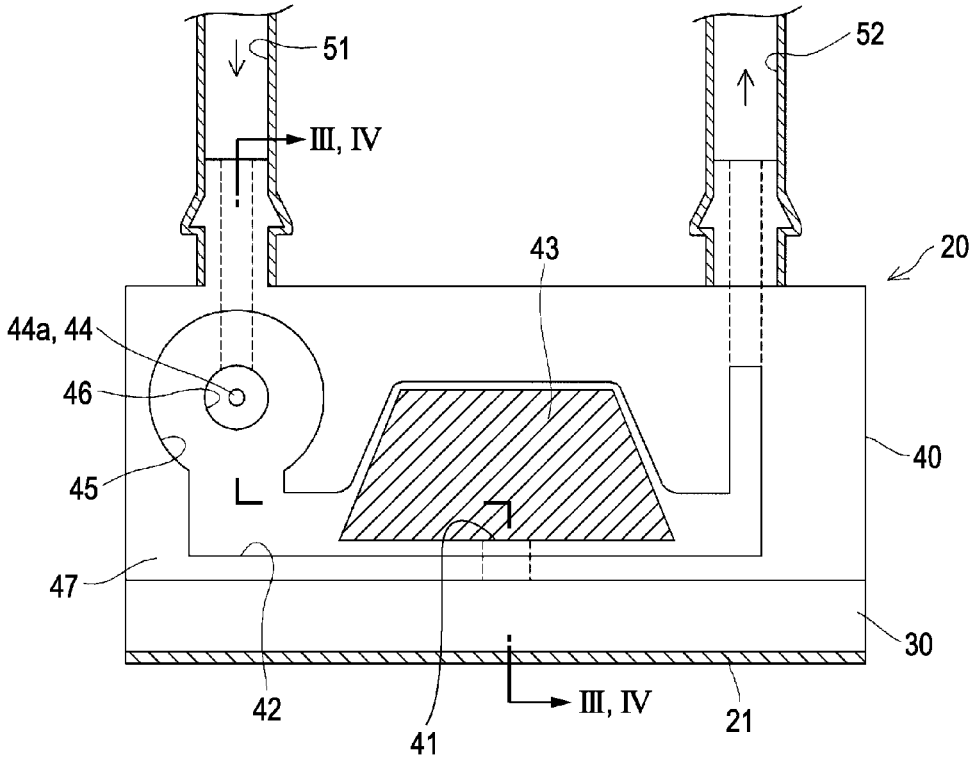
FIG. 2B is a side view of the recording head according to the first embodiment.
Figure 3:
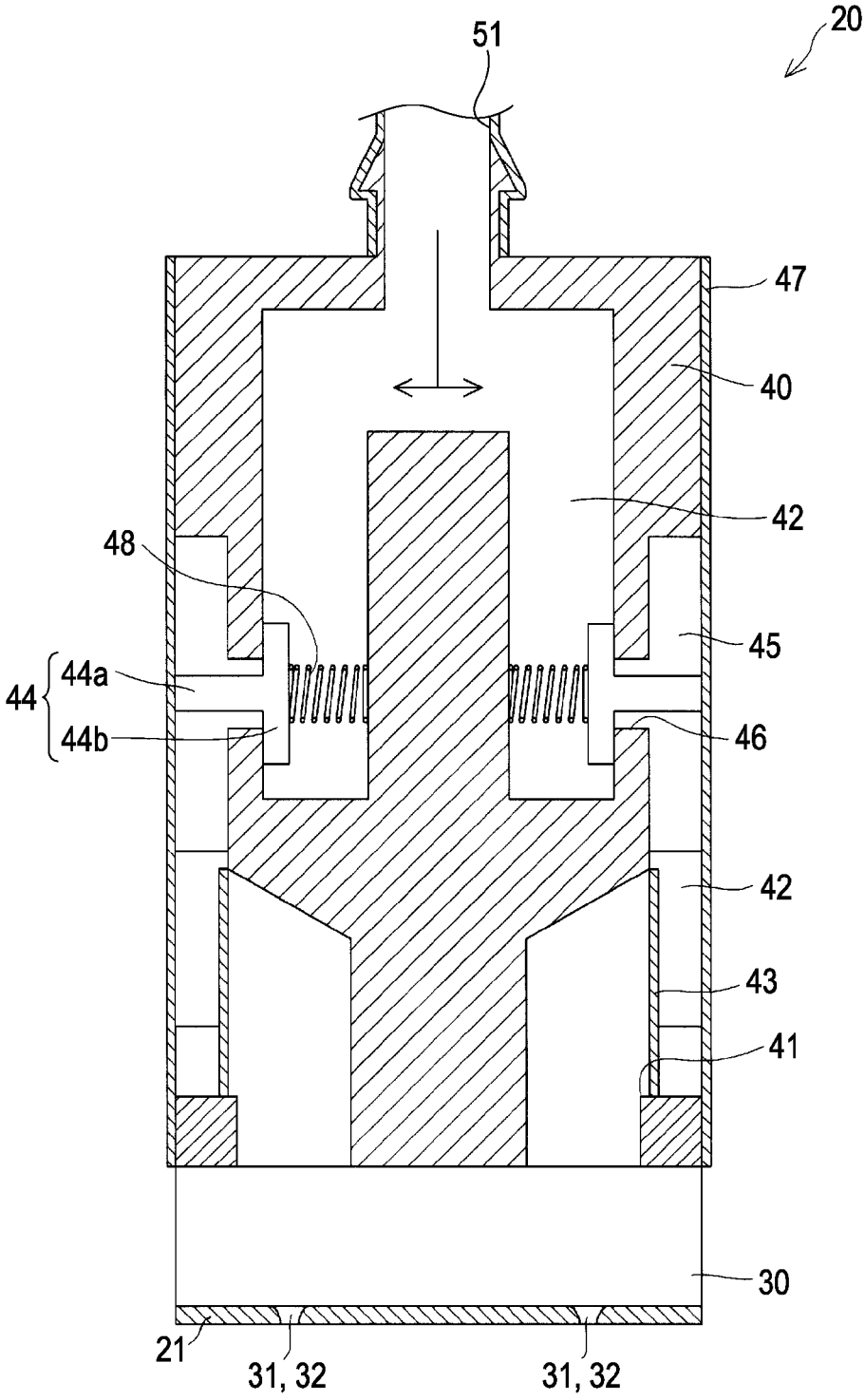
FIG. 3 is a cross-sectional view of the recording head taken along the line III-III in FIG. 2A according to the first embodiment.
Figure 4:
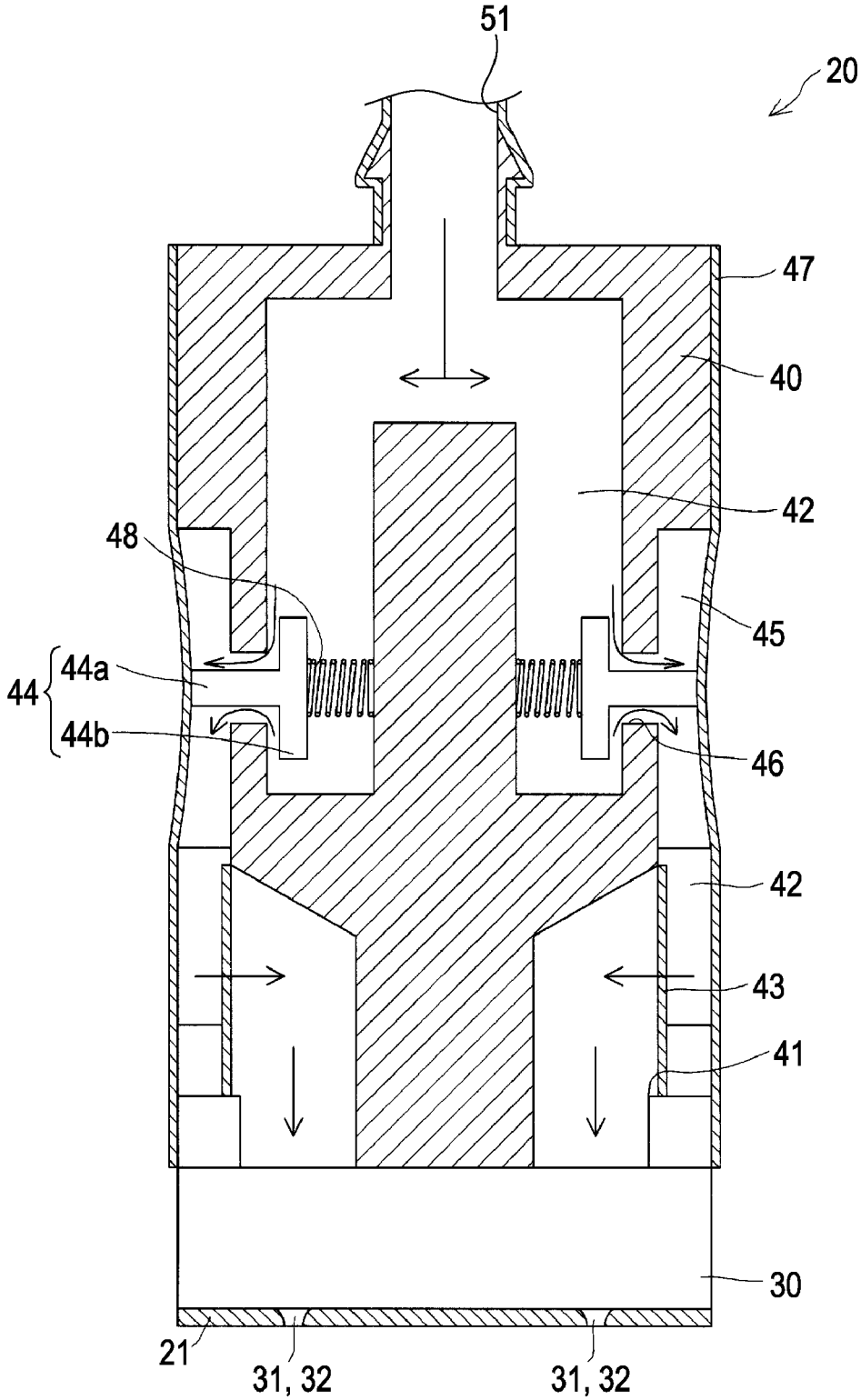
FIG. 4 is a cross-sectional view of the recording head taken along the line IV-IV in FIG. 2A according to the first embodiment.

Referring now to FIG. 2A to FIG. 4, the recording heads 20 of this configuration will be described in detail. FIGS. 2A and 2B are respectively a plan view and a side view of the ink jet recording head as an example of the liquid ejection head on the side of a discharging surface, and FIG. 3 and FIG. 4 are cross-sectional views showing a relation between the ink jet recording head and the liquid reservoir unit. Here, the recording heads 20A to 20H are explained to be the recording heads 20 having the same structure.

As shown in FIGS. 2A and 2B, the recording head 20 includes a head body 30 having nozzle openings 31 and a supply member 40 configured to supply ink to the head body 30.

The head body 30 includes a plurality of nozzle row groups made up of one or more nozzle rows 32 including the nozzle openings 31 for discharging ink arranged in a line.

In the first embodiment, two of the nozzle rows 32 are provided on the one head body 30, and the respective nozzle rows 32 correspond to the nozzle row groups 32. In other words, the nozzle row group in the first embodiment is made up of the one nozzle row 32. Therefore, in first embodiment, the nozzle row group is indicated by the same reference numeral (32) as the nozzle row 32. It is also possible to provide four nozzle rows 32 in the recording head 20 so as to configure one nozzle row group with two of the nozzle rows 32.

In the interior of the head body 30, a flow channel (not shown) which communicates with the nozzle openings 31 is provided, and ink droplets are discharged from the nozzle openings 31 by the application of pressure to the ink in the flow channel using a pressure generating unit. In first embodiment, the surface where the nozzle openings 31 open is the discharging surface 21 from which the ink droplets are discharged. The supply member 40 is provided on the head body 30 on the opposite side from the discharging surface 21 as shown in FIG. 3, and includes a plurality of circulation channels 42 which communicate with the respective nozzle row groups 32 of the head body 30 via a connecting portion 41. In first embodiment, since two of the nozzle row groups 32 are provided, the supply member 40 is provided with two circulation channels 42. In other words, the respective circulation channels 42 communicate commonly with the flow channels communicating with the respective nozzle row groups 32 via the connecting portion 41. In the first embodiment, the connecting portion 41 is provided with a filter 43, so that the ink is supplied to the head body 30 after air bubbles or foreign substances contained in the ink in the circulation channels 42 have been trapped with the filter 43. As the filter 43, a sheet-like structure formed with a plurality of fine holes by finely weaving metal, or a panel-like member such as a single metal panel or a resin panel formed with a plurality of through holes, or a non-woven fabric may be employed.

As shown in FIG. 1, and FIGS. 2A and 2B, a supply channel 51 that receives a supply of ink from the liquid reservoir unit 50, is connected commonly to the two circulation channels 42 of the recording head 20, and a collecting channel 52 that collects ink which has not been discharged from the recording head 20 to the liquid reservoir unit 50, is also connected commonly thereto. The supply channel 51 and the collecting channel 52 are formed in the interior of tubular members such as flexible tubes. The collecting channel 52 is provided with a suction pump 53, configured to suck ink on the side of the recording head 20. In association with sucking of ink from the side of the circulation channels 42 by the suction pump 53, the ink is supplied from the liquid reservoir unit 50 to the recording head 20, and the ink is collected from the recording head 20 into the liquid reservoir unit 50.

As shown in FIG. 3, the supply member 40 is provided with valve members 44 configured to open and close the circulation channels 42 on the upstream side of the circulation channels 42 with respect to the connecting portion 41. More specifically, the circulation channels 42 are each provided with a pressure chamber 45 having a concave shape opening on the surface of the supply member 40 on the upstream side thereof with respect to the connecting portion 41. The upstream sides (the side of the supply channels) of the circulation channels 42 with respect to the pressure chamber 45 are provided inward of the supply member 40 in the thickness direction and communicate with the bottom surface of the pressure chamber 45 via a through hole 46. The downstream sides with respect to the pressure chambers 45 (the side of the collecting channel 52) are each formed into a concave shape on the surface of the supply member 40 in the same manner as the pressure chamber 45, and are provided inward in the thickness direction in an area connected to the supply channel 51. The circulation channels 42 opening on the surface including the pressure chambers 45 as described above are sealed by flexible films 47 fixed to the surface of the supply member 40. The valve members 44 are provided in the pressure chambers 45. The valve members 44 each include a shaft portion 44*a* and a disk portion 44*b* provided integrally with the shaft portion 44*a* at one end, and the shaft portion 44*a* is inserted into the through hole 46 formed in the pressure chamber 45. The other end of the each valve member 44 opposite from the end where the disk portion is provided is in abutment with the film 47 via a pressure-receiving panel or the like, which is not shown. The disk portions 44*b* of the valve members 44 configured as described above each has an outer diameter larger than an inner diameter of the through hole 46. Springs 48 are provided between back surfaces of the disk portions 44*b* (the opposite side from the film 47) and wall surfaces of the circulation channels 42, and the valve members 44 are urged toward the films 47 and close the through holes 46 with the disk portions 44*b* via the springs 48, so that the circulation channels 42 are closed.

When a negative pressure is applied to the interior of the pressure chambers 45, as shown in FIG. 4, the films 47 are deformed toward the pressure chambers 45 by the pressure difference between the negative pressure in the pressure chambers 45 and the outside air pressure on the outside of the pressure chambers 45 partitioned by the films 47, and the deformation is transmitted to the valve members 44. In other words, when the pressure differences acting against the urging forces of the springs 48 are generated between the pressures (the negative pressures) in the pressure chambers 45 and the outside pressure, the films 47 are deformed toward the pressure chambers 45. Accordingly, the valve members 44 move against the urging forces of the springs 48 and gaps are formed between peripheries of the through holes 46 and the disk portions 44*b* to open the circulation channels 42.

The recording heads 20 configured in this manner are arranged, when being arranged as the recording heads 20A to 20H in the periphery of the supporting member 10, at different angles so that the two circulation channels 42 are positioned at different levels as the recording heads 20B, 20C, 20D, 20F, 20G, and 20H as shown in FIG. 1.

Figure 5:
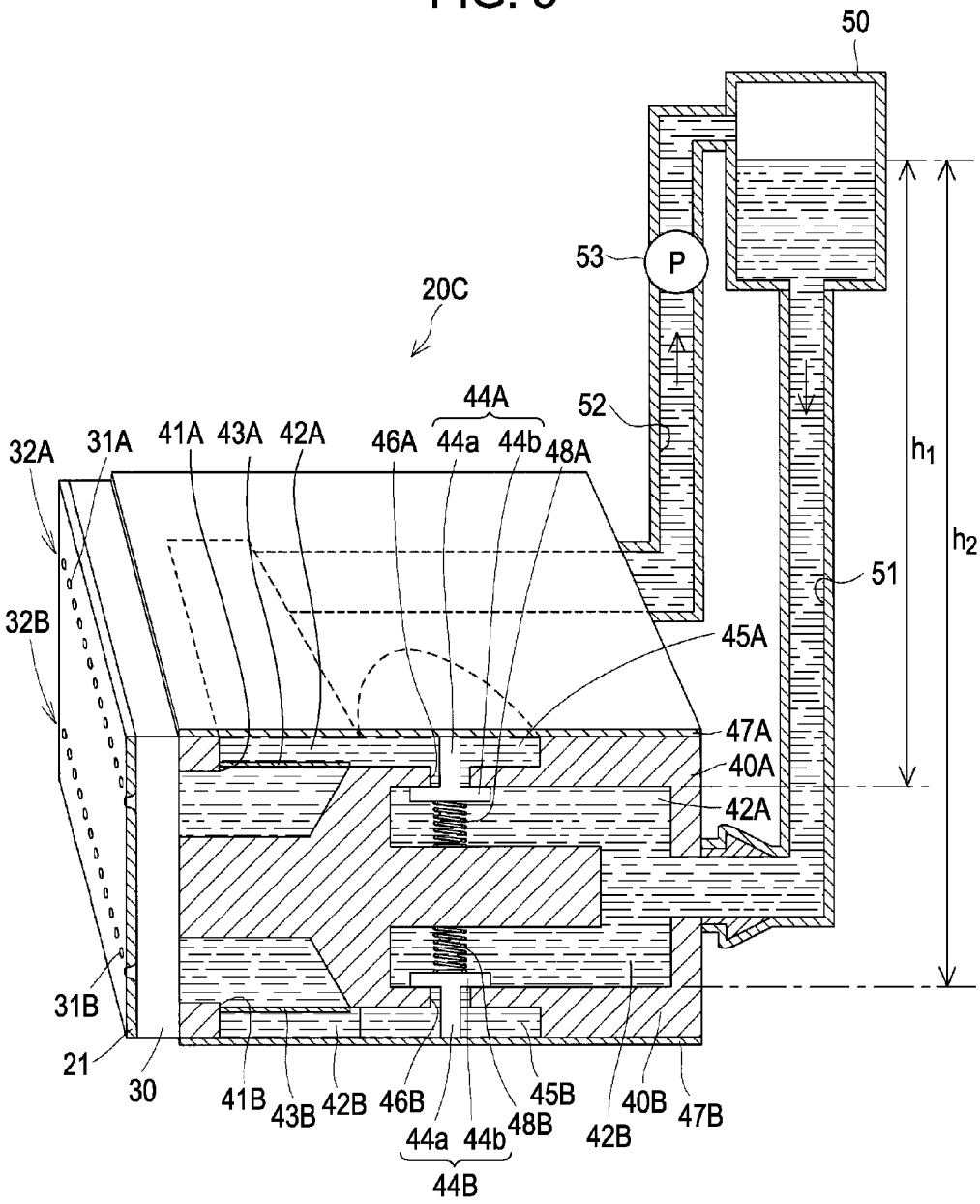
FIG. 5 is a cross-sectional view of a principal portion showing a waterhead pressure of the recording apparatus according to the first embodiment.

Referring now to FIG. 5, the difference in waterhead pressure of the respective circulation channels 42 of the recording head 20C will be described.

As shown in FIG. 5, the recording head 20C is arranged in such a manner that the direction of the plane of the discharging surface 21 extends along the vertical direction, and the nozzle row groups 32 are aligned in a line in the vertical direction. Therefore, the circulation channels 42 communicating with the respective nozzle row groups 32 are aligned in a line in the vertical direction, so that the two circulation channels 42 are arranged at different levels in the vertical direction. In the recording head 20C shown in FIG. 5, the lower side in the drawing is defined as vertically down, and the circulation channel 42, the pressure chamber 45, and so on arranged on the upper side in the vertical direction are designated with reference numerals affixed with the symbol "A", and the circulation channels 42, the pressure chamber 45, and so on arranged on the lower side in the vertical direction are designated with reference numerals affixed with the symbol "B".

In the recording head 20C configured as described above, heights $h_1$ and $h_2$ from the ink levels stored in the liquid reservoir unit 50 to circulation channels 42A and 42B (through holes 46A, 46B) opened and closed by valve members 44A and 44B are different in the two circulation channels 42A and 42B. Then, since the heights (waterhead pressures) $h_1$ and $h_2$ from the ink levels to the through holes 46A and 46B are different, there arises a difference between pressures $P_1$ and $P_2$ applied to the portions of the through holes 46A and 46B of the circulation channels 42A and 42B. The pressures $P_1$ and $P_2$ described here are determined by the waterhead pressures $h_1$ and $h_2$ in a state in which the suction pump 53 is stopped and the weight of the ink.

As a result of setting a first pressure (negative pressure) P to be generated in pressure chambers 45A and 45B as the circulation channels 42A and 42B on the downstream side of the valve members 44A and 44B with the suction pump 53 to be higher than a second pressure $P_3$ in the pressure chambers 45A and 45B required for operating the films 47 so as to cause the valve members 44A and 44B to open the circulation channels 42A and 42B (the through holes 46A and 46B), the valve members 44A and 44B open the circulation channels 42A and 42B to supply ink in the circulation channels 42A and 42B to respective nozzle row groups 32A and 32B of the head body 30 via connecting portions 41A and 41B.

In this manner, when the valve members 44A and 44B open the circulation channels 42A and 42B, the pressures $P_1$ and $P_2$ caused by the waterhead pressures $h_1$ and $h_2$ respectively are applied to the pressure chambers 45A and 45B. Accordingly, the pressures in the pressure chambers 45A and 45B become sums of the negative pressure P applied by the suction pump 53 and the positive pressures $P_1$ and $P_2$ generated by the waterhead pressures $h_1$ and $h_2$, that is, pressures $P+P_1$ and $P+P_2$. At this time, since the first pressure P is a negative pressure and the pressures $P_1$ and $P_2$ generated by the waterhead pressures $h_1$ and $h_2$ are positive pressures, the pressures $P_1$ and $P_2$ act to cancel the first pressure P. Accordingly, the pressures in the pressure chambers 45A and 45B are lower than the first pressure P. The valve members 44A and 44B close the circulation channels 42A and 42B as a result of reduction of the pressure $P+P_1$ and the pressure $P+P_2$ in the pressure chambers 45A and 45B to pressures lower than the second pressure $P_3$. In this manner, when the valve members 44A and 44B close the circulation channels 42A and 42B, the pressures $P_1$ and $P_2$ generated by the waterhead pressures $h_1$ and $h_2$ are no longer applied to the pressure chambers 45A and 45B. Therefore, the pressure chambers 45A and 45B are brought to the pressure P only by the suction pump 53, whereby the ink is sucked therefrom. When the ink in the pressure chambers 45A and 45B is sucked by the suction pump 53 and the pressures in the pressure chambers 45A and 45B reach the pressure P, the valve members 44A and 44B open the circulation channels 42A and 42B. In other words, even with the two circulation channels 42A and 42B having different pressures $P_1$ and $P_2$ generated by the waterhead pressures $h_1$ and $h_2$, the pressure on the downstream side of the two circulation channels 42A and 42B with respect to the valve members 44A and 44B (the connecting portions 41A and 41B) can be maintained to a constant value equal to or lower than the pressure $P_3$ of the pressure chambers 45A and 45B where the valve members 44A and 44B are operated by repeated opening and closing of the circulation channels 42A and 42B, that is, closing the circulation channels 42A and 42B by the application of the pressures $P_1$ and $P_2$ generated by the waterhead pressures $h_1$ and $h_2$ to the pressure chambers 45A and 45B in a state in which the valve members 44A and 44B open the circulation channels 42A and 42B and opening the valve members 44A and 44B by the application of only the pressure P of the suction pump 53 to the pressure chambers 45A and 45B.

The pressure $P_1$ generated by the first pressure P+ the waterhead pressure $h_1$ is applied to the pressure chamber 45A, and the pressure $P_2$ generated by the first pressure P+ the waterhead pressure $h_2$ is applied to the pressure chamber 45B. However, since the pressure $P_2$ generated by the waterhead pressure $h_2$ and applied to the pressure chamber 45B is higher than the pressure $P_1$ generated by the waterhead pressure $h_1$ and applied to the pressure chamber 45A, the pressure chamber 45B reaches a pressure lower than the second pressure $P_3$ in a period shorter than the pressure chamber 45A. Therefore, in the two circulation channels 42A and 42B, the periods required for the valve members 44A and 44B to open the circulation channels 42A and 42B and then close the same are different. However, in the two circulation channels 42A and 42B, only the periods during which the circulation channels 42A and 42B are opened are different, but the pressures in the two circulation channels 42A and 42B on the downstream side with respect to the valve members 44A and 44B (the pressure chambers 45A and 45B) can be equalized to a constant value. Therefore, by uniformizing the pressure of the ink to be supplied to the connecting portions 41A and 41B of the circulation channels 42A and 42B different in height in the vertical direction and uniformizing the supply characteristics, the discharging characteristics of the ink droplets discharged from the two nozzle row groups 32 can be uniformized. Accordingly, improvement of the printing quality is achieved.

For example, when the valve members 44 are not provided in the respective circulation channels 42A and 42B, there arises a difference between the pressures $P_1$ and $P_2$ generated by the waterhead pressures $h_1$ and $h_2$ applied to the connecting portions 41A and 41B. Therefore, the supply pressure is changed and hence the ink discharging characteristics when discharging ink are affected, so that the ink cannot be discharged from all the nozzle row groups with uniform discharging characteristics.

The recording head 20 provided with the valve members 44 in the respective circulation channels 42 may be employed also as the recording head 20B, 20D, 20F, 20G, and 20H arranged in which the two circulation channels 42 are positioned at different levels in the vertical direction instead of the recording head 20C. In this case as well, the valve members 44 are operated in the same manner as the recording head 20C so that the pressures on the downstream side (the connecting portion 41) of the circulation channels 42 with respect to the valve member 44 are maintained uniformly, and ink can be supplied to the respective nozzle row groups 32 of the head body 30 at a uniform pressure.

The recording head 20 provided with the valve members 44 in the respective circulation channels 42 configured in this manner may be employed not only as the recording heads 20B, 20C, 20D, 20F, 20G, and 20H in which the two circulation channels 42 are positioned at levels different in the vertical direction, but also as the recording head 20A and 20E in which the two circulation channels 42 are positioned at the same level in the vertical direction. Since the recording heads 20A and 20E have the two circulation channels 42 provided horizontally, there arises no difference in waterhead pressure. However, even though the valve members 44 are provided, the pressure on the downstream sides of the two circulation channels 42 with respect to the valve members 44 can be uniformized. In this manner, in the ink jet recording apparatus 1 having the plurality of recording heads 20A to 20H, by employing the recording heads 20 having a single structure as the recording heads 20A to 20H, the necessity of arranging recording heads having different structures at predetermined positions is eliminated. Therefore, defective discharge due to erroneous assembly is prevented and the manufacturing process can be simplified. Since the recording heads 20 having the same structure may be manufactured in contrast to the case of preparing a plurality of recording heads having different structures, reduction of the cost is achieved. As a matter of course, it is also possible to use the structure of the recording head 20 described above only as the recording heads 20B to 20D and 20F to 20H having the two circulation channels 42 positioned at different levels in the vertical direction, and use the recording head 20A and 20E having no valve member 44 in the circulation channels 42.

In the first embodiment, ink is supplied from the one liquid reservoir unit 50 to the plurality of recording heads 20A to 20H as shown in FIG. 1. Therefore, the respective recording heads 20A to 20H are different in mounting position in the vertical direction, and hence there arises a difference in the supply pressure of ink due to the difference in waterhead pressure. However, as described above, with the provision of the valve members 44 which cause the pressure chambers 45 to be operated at a predetermined pressure in the respective circulation channels 42, the pressures downstream of the valve members 44 to supply ink to the head body 30 can be uniformized among the respective recording heads 20A to 20H, so that the discharge characteristics of ink to be discharged from the plurality of recording heads 20A to 20H can be uniformized. In this configuration as well, improvement of the printing quality is achieved.

According to the configuration in the first embodiment, the ink from the liquid reservoir unit 50 is circulated through the supply channel 51, the circulation channels 42, and the collecting channel 52. Therefore, components contained in the ink are restrained from settling out, and air bubbles contained in the ink are collected from the recording head 20 into the liquid reservoir unit 50, so that problems caused by the air bubbles can be restrained.

Other Embodiments

The first embodiment of the invention has been described thus far. However, the basic configuration of the invention is not limited to that described above. For example, in the first embodiment described above, the ink is supplied from the one liquid reservoir unit 50 to the recording heads 20A to 20H. However, the invention is not limited thereto and, for example, a configuration having a liquid reservoir for supplying ink independently to the recording heads 20A to 20H is also applicable. However, since the liquid reservoir unit 50 is generally arranged to the same position (the same height in the vertical direction) in the recording apparatus 1 in substantially many cases, probability of occurrence of different waterhead pressures in the respective recording heads 20A to 20H in the same manner as the first embodiment described above is high. However, with the provision of the valve members 44 in the respective circulation channels 42 of the respective recording heads 20A to 20H, variations in supply pressure due to the difference in waterhead pressure are restrained, and hence the discharging characteristics can be uniformized.

In the first embodiment described above, an example in which the suction pump is provided in the collecting channel has been described. However, the invention is not limited thereto, and a pressure pump configured to feed ink to the recording heads 20A to 20H may be provided in the supply channel in addition to the suction pump. Even in the case where the pressure pump is provided in this manner, the difference in waterhead pressure is generated among the circulation channels 42 of the recording heads 20B to 20D and 20F to 20H, and there arises a difference in waterhead pressure among the recording heads 20A to 20H.

Figure 6:
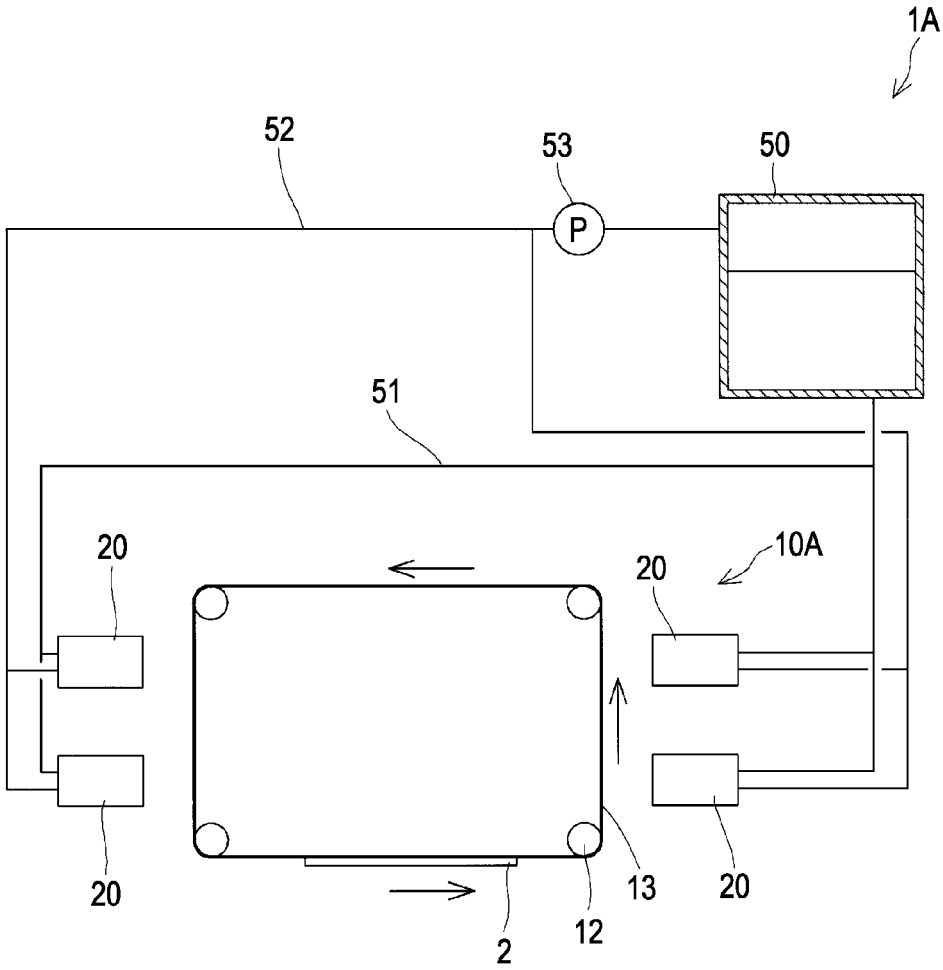
FIG. 6 is a plan view of a recording apparatus showing another example of a supporting member according to another embodiment.

In the first embodiment described above, the supporting member 10 has a column shape and is configured to be rotated. However, the invention is not limited thereto. Here, another example of the supporting member is shown in FIG. 6. FIG. 6 is a rough plan view of an ink jet recording apparatus according to another embodiment of the invention. As shown in FIG. 6, an ink jet recording apparatus 1A includes a supporting member 10A and the plurality of recording heads 20.

The supporting member 10A includes a plurality of rollers 12 and a platen belt 13 configured to be rotatable in a state of being entrained about the plurality of rollers 12.

With the provision of the platen belt 13 configured as described above, the ink-ejected medium 2 is transported with the ejected surface faced up and down in the vertical direction and is supported on the opposite side from the ejected surface.

There are provided two each, four in total ink jet recording heads 20 on both sides of the platen belt 13 in the horizontal direction orthogonal to the vertical direction. In this configuration as well, in the same manner as the first embodiment described above, the supply pressure of ink to the head body can be uniformized and hence the ink discharging characteristics can be uniformized with the provision of the recording heads 20 each having the valve members 44 in the respective circulation channels 42.

In the example shown in FIG. 6, the rollers 12 are arranged at corners of a rectangular shape to deform the platen belt 13 into the rectangular shape. However, the shape of the platen belt 13 is not specifically limited thereto. The supporting members 10 and 10A are not limited to those described above, and the table-shaped supporting member may be provided so as to be movable upward, downward, leftward, and rightward and in the direction of rotation, for example.

The invention is aimed generally at a wide range of liquid ejection heads. For example, the invention can be applied to various types of recording heads such as the ink jet recording heads used for an image recording apparatus such as printers, coloring material ejection heads used for manufacturing color filters such as liquid crystal displays, electrode material ejection heads used for forming electrodes for displays such as organic EL displays or FED (field emission displays), and also biological organic substance ejection heads used for manufacturing biological chips.

What is claimed is:

1. A liquid ejecting apparatus comprising:

a liquid reservoir unit having liquid stored therein;

a liquid ejection head having a plurality of nozzle rows including nozzle openings aligned in a line for ejecting liquid;

a supply channel configured to supply the liquid from the liquid reservoir unit to the liquid ejection head;

a collecting channel through which the liquid is collected from the liquid ejection head into the liquid reservoir unit; and a suction pump provided in the collecting channel and configured to suck the liquid in the liquid ejection head, wherein the liquid ejection head includes a plurality of circulation channels provided so as to communicate with the respective nozzle row groups each made up of one or more nozzle rows and allowing the supply channel and the collecting channel to communicate with each other, each of the circulation channels includes: a valve member provided on the upstream side of a connecting portion which communicates with the nozzle row group of the circulation channel and configured to open and close the circulation channel; and a film configured to seal the circulation channel, be displaced toward the circulation channel by the negative pressure and the atmospheric pressure which act on the circulation channel on the downstream side with respect to the valve member, and open the circulation channel by moving the valve member by transmitting the displacement to the valve body, a first pressure applied to the downstream side of the valve member in the circulation channel by the suction pump is larger than a second pressure on the downstream side of the valve member in the circulation channel required for causing the film to act so that the valve member opens the circulation channel, and a sum of a waterhead pressure determined by the height from the liquid reservoir unit to the circulation channel opened and closed by the valve member provided in each of the circulation channel and the first pressure is smaller than the second pressure.

2. The liquid ejecting apparatus according to claim 1, comprising a plurality of the liquid ejection heads, wherein the plurality of liquid ejection heads are provided at different levels in the vertical direction.

* * * * *